United States Patent [19]

Sutton

[11] Patent Number: 4,810,362

[45] Date of Patent: Mar. 7, 1989

[54] METHOD FOR CLEANING FOSSIL FUEL, SUCH AS COAL AND CRUDE OIL

[75] Inventor: Robert C. Sutton, Peoria, Ill.

[73] Assignee: Sutton Energy Corporation, Washington, Ill.

[21] Appl. No.: 31,744

[22] Filed: Mar. 30, 1987

[51] Int. Cl.[4] ..... C10G 29/06

[52] U.S. Cl. ..... 208/246; 208/191; 44/622; 44/623; 44/629

[58] Field of Search ..... 208/191, 246; 44/1 SR, 44/2, 622

[56] References Cited

U.S. PATENT DOCUMENTS

| | | | |
|---|---|---|---|
| 525,969 | 9/1894 | Sommer | 208/246 |
| 747,347 | 12/1903 | Amend | 208/246 |
| 747,348 | 12/1903 | Amend | 208/246 |
| 1,725,068 | 8/1929 | Egloff | 208/246 |
| 1,799,431 | 4/1931 | Morrell | 208/246 |
| 2,149,035 | 2/1939 | Hugo et al. | 208/246 |
| 2,276,526 | 3/1942 | Von Fuchs et al. | 208/246 |
| 2,768,931 | 10/1956 | Richard et al. | 208/246 |
| 2,768,932 | 10/1956 | Richard et al. | 196/36 |
| 2,776,246 | 1/1957 | Hutchings et al. | 208/246 |
| 2,897,142 | 1/1959 | Jacobs et al. | 208/246 |
| 3,145,161 | 8/1964 | Anderson et al. | 208/246 |
| 3,276,186 | 10/1966 | Hronus et al. | 208/246 |
| 4,113,606 | 9/1978 | Mulaskey | 208/246 |
| 4,149,966 | 4/1979 | O'Donnell et al. | 208/246 |
| 4,163,708 | 8/1979 | Jacobson et al. | 208/246 |
| 4,204,947 | 5/1980 | Jacobson et al. | 208/246 |
| 4,314,902 | 2/1982 | Bouk | 208/246 |
| 4,409,123 | 10/1983 | Hector | 208/246 |
| 4,442,221 | 4/1984 | Bishop, III et al. | 208/246 |
| 4,491,454 | 1/1985 | Lompa-Krzymien | 44/1 SR |
| 4,610,780 | 9/1986 | Grove et al. | 208/246 |

FOREIGN PATENT DOCUMENTS

| | | | |
|---|---|---|---|
| 943093 | 3/1974 | Canada | 44/1 SR |

*Primary Examiner*—H. M. S. Sneed
*Assistant Examiner*—Helane Myers
*Attorney, Agent, or Firm*—Frank H. Foster

[57] ABSTRACT

Contaminants, such as sulphur, sulphur compounds and other pollutants are removed from fossil fuels. The fossil fuel in a liquid medium, such as crude oil or a coal slurry, is exposed to metallic copper to react the sulphur with copper ions and settle out the resulting copper sulphide. Additional additives are also disclosed.

13 Claims, 3 Drawing Sheets

FIG. 2 COAL

| SAMPLE ID | TREATMENT ID | SULFUR % BY WEIGHT DRY BASIS | | ASH % BY WEIGHT DRY BASIS | |
|---|---|---|---|---|---|
| | | Before Treat. | After Treat. | Before Treat. | After Treat. |
| 1 Coal-Ireland Aug. 86 | 40 Mesh | 4.47 | 4.26 | 20.43 | 24.9 |
| 2 Same | 1/4" | 4.47 | 4.36 | 20.43 | 17.04 |
| 3 Coal-unwashed samples July 10, 1986 | I-3 | 4.32 | 4.04 | 19.43 | 31.48 |
| 4 " | II-3 | " | 4.08 | " | 26.46 |
| 5 " | III-3 | " | 3.83 | " | 22.69 |
| 6 Coal-washed July 10, 1986 | I-1 | " | 4.38 | " | 7.4 |
| 7 | II-1 | " | 4.46 | " | 7.12 |
| 8 | III-1 | " | 4.35 | " | 7.21 |
| 9 | I-2 | " | 4.08 | " | 10.40 |
| 10 | II-2 | " | 3.89 | " | 6.57 |
| 11 | III-2 | " | 3.94 | " | 7.64 |

FIG. 3

OIL

| SAMPLE ID | TREATMENT ID | SULFUR % WEIGHT Before Treat. | SULFUR % WEIGHT After Treat. | ASH % WEIGHT Before | ASH % WEIGHT After | POUR POINT Before | POUR POINT After | BTU/lb Before | BTU/lb After |
|---|---|---|---|---|---|---|---|---|---|
| 1. North Slope Crude 5-19-86 | #1 Heavy Fraction | 1.02 | 1.12 | 0.01 | 0.02 | | | | |
| 2. " | #1 Light Fraction | " | 1.08 | " | 0.02 | | | | |
| 3. " | #2 Heavy Fraction | " | 1.03 | " | 0.01 | | | | |
| 4. " | #2 Light Fraction | " | 1.04 | " | 0.02 | | | | |
| 5. " | Treated With Waste | " | 1.03 | " | 0.02 | | | | |
| 6. Illinois Crude 1-16-87 | Heavy DC | 0.20 | 0.36 | 0.01 | 0.01 | 25°F | 25°F | 19,180 | 19,382 |
| 7. " | | " | 0.32 | " | 0.01 | " | 25°F | | |
| 8. " | (D) | " | 0.29 | " | 0.00 | " | 20°F | " | 19,280 |
| 9. West Texas Crude 1-16-87 | (D) | 1.60 | 1.66 | 0.02 | 0.03 | 30°F | 40°F | 18,739 | 18,807 |
| 10. " | AC #2 Burner Fuel | " | 1.64 | " | 0.01 | " | 25°F | " | 18,740 |
| 11. " | Treated + Heavy AC | " | 1.77 | " | 0.01 | " | 5°F | " | 18,764 |

METHOD FOR CLEANING FOSSIL FUEL, SUCH AS COAL AND CRUDE OIL

TECHNICAL FIELD

This invention relates generally to the removal of contaminants from fossil fuels, such as coal and crude oil, in order to reduce the pollution caused by the combustion of such fuels and more particularly this invention relates to the removal of sulphur and other pollutants by a low cost chemical reaction.

BACKGROUND ART

Industry, government and individual citizens have a need for improved energy resources which can meet the energy needs of the nation and yet are environmentally acceptable because they cause the emission of little or no pollution. One of the principal and most objectionable pollutants is sulphur.

The Clean Air Act of 1970 has stimulated research for cleaner fuels. Many experts believe that sulphur compounds released by the combustion of sulphur bearing fuels cause not only the direct effect of polluting air breathed by all citizens but also cause acetic precipitation which has a long range indirect effect on people by injuring or destroying vegetation and aquatic life.

While the United States has very substantial coal reserves, the problems with contaminants have caused restrictions upon the use of coal which in turn have caused economic hardship upon segments of the U.S. population. Therefore an inexpensive method for desulfurizing fossil fuels would increase available energy, improve the environment and the quality of life and be an economic stimulus.

Numerous methods for desulfurizing fossil fuels have been explored. These include physical separation techniques, chemical processes, and bacterial oxidation.

One of the problems with chemical processes is that they often use a variety of solvents, including quinoline, toluene, petroleum ether, and household bleach. They have met with some success under laboratory conditions. However, the difficulty is that chemical processes are not economically acceptable on an industrial scale because of their high cost and the by-product disposal problems which they create. In addition, existing apparatus for removal of pollutants, including sulphur, from fossil fuels is large and bulky, expensive and not,easily moved from one location to another.

It is a purpose of the present invention to provide an apparatus and method for the removal of pollutants, such as sulphur, from oil and coal which invention requires simpler, smaller, equipment and is less expensive than currently available apparatus and techniques. The apparatus of the present invention is capable of being installed in a typical field operation and in a limited space and can easily be moved from one location to another.

BRIEF DISCLOSURE OF INVENTION

In the present invention fossil fuel in a liquid medium, such as crude oil or coal slurry, is exposed to metallic copper surfaces to effect the reaction of sulphur and sulphur compounds in the fuel with copper ions in the liquid to precipitate copper sulfide and then that precipitate is removed. The method is advantageously practiced in a receptacle containing a plurality of preferably parallel copper tubes and connected to a common inlet at one end of the receptacle and a common outlet at the opposite end of the receptacle for conducting a stream of fossil fuel, such as oil or coal slurry, past the copper tubes, both through their interior and about their exterior in order to expose the fuel to the copper surface. Desirably a means for stirring, such as an impeller or rotating paddle wheel, agitates or creates turbulence in the fuel stream to stir the liquid in the receptacle.

BRIEF DESCRIPTION OF DRAWINGS

FIG. 2 is a table of data illustrating the treatment of coal in accordance with the present invention.

FIG. 3 is a table of data illustrating the treatment of crude oil in accordance with the present invention.

Figure 1:
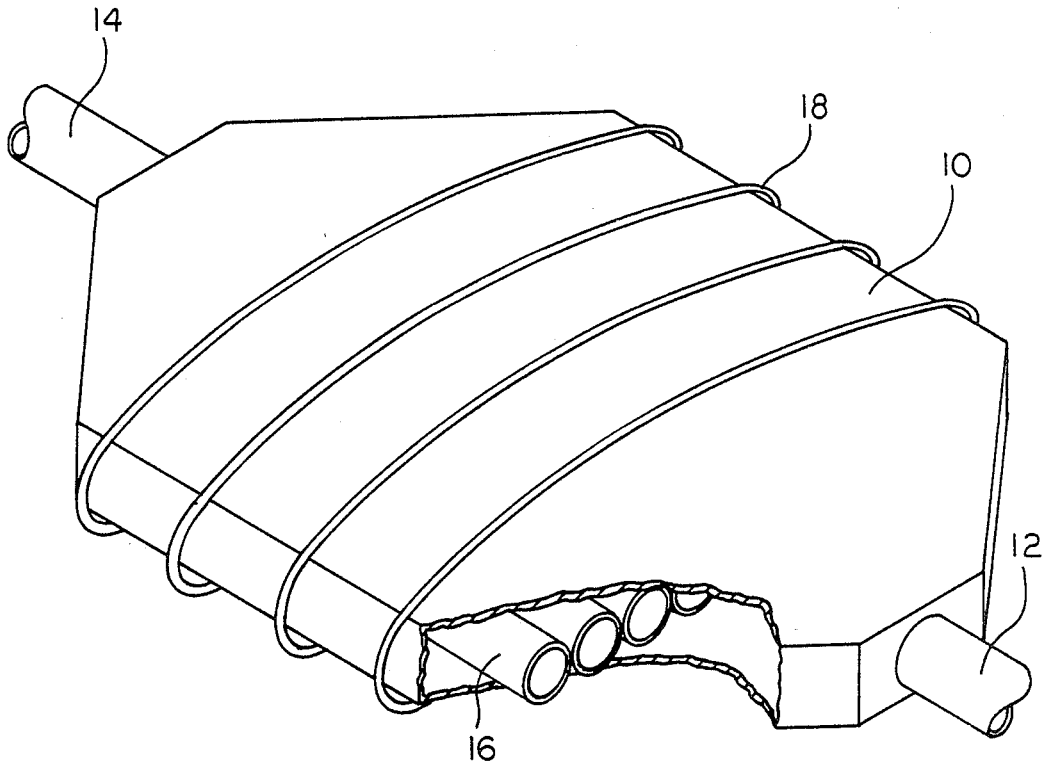
FIG. 1 is a view in perspective of an apparatus embodying the present invention for practicing the method of the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

FIG. 1 illustrates a copper receptacle 10 having an inlet pipe 12 and an outlet pipe 14. In the embodiment utilized to practice the invention for experimental purposes, the receptacle 10 was constructed of ¼ inch thick copper plate. Mounted within the receptacle 10 are a plurality of parallel copper tubes 16 which, in the experimental embodiment, were one and one-half inch diameter copper tubes.

The fossil fuel in a liquid medium is pumped into the inlet tube 12 and passes both through the interior and about the exterior of the tubes 16 and then out the outlet tube 14 after treatment.

Thus, the fossil fuel in the liquid medium is free to contact the interior surface of the receptacle 10 as well as both the interior and exterior surfaces of the tubes 16.

It is desirable to continuously stir the liquid in the receptacle 10 during the treatment period. This may be accomplished, for example with a coal slurry, by means of an induction coil 18 connected to a suitable alternating source to provide induction stirring. Alternatively, of course, impellers or paddles may be positioned in the receptacle for causing the stirring action, particularly when treating crude oil. Desirably, a lower portion of the receptacle 10 is formed as a sump, particularly when treating crude oil, to collect the waste products which are precipitated during the process.

Desirably this sump is approximately 5% to 10% of the tank volume.

Alternatively, tanks or receptacles of other shapes may be utilized and the active copper surfaces may be provided, for example, by helical tubes with flow being along a helical path. As another alternative copper plates may be suspended within the receptacle.

In practicing the method of the present invention, the fossil fuel as a liquid medium is exposed to metallic copper surfaces in a liquid medium to effect the reaction of sulphur and sulphur compounds in the fuel with the copper. It is believed that small portions of the copper ionize and react with the sulphur and sulphur compounds to precipitate copper sulfide which settles to the bottom of the receptacle, such as the receptacle 10.

Desirably, the liquid is stirred during treatment as described above in order to circulate the liquid in contact with the copper to promote ionization and reaction.

Since crude oil is already a liquid, it may be treated in its natural form in accordance with the method of the present invention.

Coal may be treated by grinding it into a fine particulate matter of 15 mesh to 45 mesh and mixing it with water to form a coal slurry.

Preferably, prior to exposing the fuel to the copper surfaces the copper is treated with an acid, such as acetic acid. It is believed that this removes copper compounds from the surface to activate the copper surface. In the test embodiment of the invention acetic acid was used in the form of a component of vinegar.

When treating coal slurry it is desirable to also add approximately 2% of a dilute acid, such as 2% vinegar, to the coal slurry before treatment. This adjusts the ph and assists in removing copper sulfide from the surface of the copper tubes in order to prevent surface passivation of the metallic copper which would halt the reaction.

It is also desirable to mix an alkali, such as sodium carbonate, with the coal slurry at the approximate concentration of 0.0005% by weight. For example, in the test embodiment calcium carbonate was added at a rate of about one pound of calcium carbonate per ton of coal. The calcium carbonate in combination with the vinegar assists in the removal of ash from the fossil fuel.

Additionally, it has been found desirable to mix approximately 2% by weight of copper sulfate with the coal slurry which assists in the removal of inherent moisture and increases the BTU value of the treated fuel.

No such additives are necessary when treating crude oil, but may be used if desired.

It is further desirable to pretreat the copper tubes (in both the oil and coal treatments) with a solution of Sodium Carbonate. This treatment forms a surface coating of basic copper carbonate (commonly known as verdigris) which accelerates the ionization of the surface copper. This will materially expedite the reaction with the sulfur in the substrate. Because copper sulfide is one of the more insoluble substances known in the inorganic field, the reaction is thus driven to substantial completion.

In addition, heating the fossil fuel to within the range of approximately 110° F. and 120° F. will hasten the reaction.

Following treatment of coal in accordance with the present invention, a conventional float/sink treatment of the coal slurry removes rock and similar sediments from the treated coal product.

In practicing the present invention, as with many such processes, the longer the treatment is administered the more effective are the results. However, diminishing returns are reached and I have found that approximately 48 hours of treatment is effective. However, the fuel may be treated for 24 hours with effective results.

Treatment of fossil fuel in accordance with the present invention reduces the sulphur content and increases the BTU value of the fossil fuel. In addition, it improves the pour point of treated oil.

While certain preferred embodiments of the present invention have been disclosed in detail, it is to be understood that various modifications may be adopted without departing from the spirit of the invention or scope of the following claims.

We claim:

1. A method for removing sulphur and sulphur compounds from a liquid stream of crude oil based fossil fuel, the method comprising:

contacting metallic copper surfaces with the fuel to effect the reaction of sulphur and sulphur compounds with the copper to precipitate copper sulfide from the liquid stream and then removing the precipitate.

2. A method for removing sulphur and sulphur compounds from a liquid stream of coal fuel, the method comprising:

(a) forming the coal fuel into particles and mixing the particles with water to form a coal slurry;

(b) contacting metallic copper surfaces with the coal slurry to effect the reaction of sulphur and sulphur compounds with the copper to precipitate copper sulfide and then removing the precipitate.

3. A method in accordance with claim 1 or 2 wherein the liquid stream is stirred to circulate the fuel in contact with the copper.

4. A method in accordance with claim 1 or 2 wherein, prior to exposing the fuel to the copper surfaces, the copper is treated with an acid applied to the copper surfaces

5. A method in accordance with claim 4 wherein the acid is acetic acid.

6. A method in accordance with claim 5 wherein the acetic acid is in the form of a component of vinegar.

7. A method in accordance with claim 2 wherein an alkali is mixed in the coal slurry at a concentration of approximately 0.0005%.

8. A method in accordance with claim 7 wherein the alkali comprises sodium carbonate.

9. A method in accordance with claim 7 approximately 2% vinegar and 2% copper sulphate are mixed in the slurry.

10. A method in accordance with claim 2 wherein the coal is present in a range of about 15–45 mesh particle size.

11. A method in accordance with claim 2 wherein the coal slurry additionally comprises about two weight percent copper sulfate.

12. A method in accordance with claim 2 wherein the liquid stream of coal fuel is heated to about 110°–120° F.

13. A method in accordance with claim 1 wherein the liquid stream of fossil fuel is heated to about 110°–120° F.

* * * * *